United States Patent [19]

Tsuruta

[11] 3,986,500

[45] Oct. 19, 1976

[54] METHOD AND APPARATUS FOR A THERAPEUTIC TREATMENT OF NEARSIGHTEDNESS

[76] Inventor: Haruo Tsuruta, 704-2, Oaza-Nuki, Kokura-Minami Kitakyushu, Fukuoka, Japan

[22] Filed: July 7, 1975

[21] Appl. No.: 593,344

[52] U.S. Cl. ..... 128/76.5; 351/2

[51] Int. Cl.[2] ..... A61H 5/00

[58] Field of Search ..... 128/76.5; 351/1, 2, 351/30, 32, 39

[56] References Cited

UNITED STATES PATENTS

| | | | |
|---|---|---|---|
| 1,811,034 | 6/1931 | Updegrave | 128/76.5 |
| 2,024,194 | 12/1935 | Wyckoff | 128/76.5 |
| 2,380,508 | 7/1945 | Eaves | 128/76.5 |

*Primary Examiner*—John D. Yasko
*Attorney, Agent, or Firm*—Frank J. Jordan

[57] ABSTRACT

A method for therapeutic treatment of nearsightedness by a repetition of focusing and staring alternatively at a distant object and a nearby object and a visual acuity chart used therefor of which sizes and locations of the break of the Landolt's ring can be made selectively changeable.

11 Claims, 16 Drawing Figures

METHOD AND APPARATUS FOR A THERAPEUTIC TREATMENT OF NEARSIGHTEDNESS

BACKGROUND OF INVENTION

This invention relates to a method for the therapeutic treatment of nearsightedness and a visual acuity chart used therefor, and more particulary to a method for therapeutic treatment of nearsightedness by relaxing the abnormal tension of the ciliary muscle of the eye which causes the nearsightedness as well as to a visual acuity table which is specifically employed in the above method.

The general structure of the eye which occupies an essential part in the description of this invention is explained before the method of this invention is described in detail.

It is well known that the eye mainly comprises a cornea 1 which is the forwardmost surface of the eyeball, an iris 2 which is located in back of the cornea, a lens which is shaped like a concave artificial lens 3, a ciliary body 4 which includes the ciliary muscle, vitreous body 5 which is transparent and the retina 6. The cornea maintains the fixed shape of the eyeball and focuses light rays onto the fundus by reflecting them; the iris works like an adjustable diaphragm in a camera to increase and decrease the amount of light reflected into the eye from the object which is seen.

The lens 3 adjusts and reflects the incoming light in conjunction with the cornea 1 in such a way that the intensity of reflection of the lens is adjustable corresponding to the distance between the nearby or distant object which is seen and the eyeball so that the clear image is focused on the retina of the eyeball. The ciliary body adjusts the thickness of the lens by contracting or elongating the lens using the ciliary muscle, and the retina receives the light energy passed through the lens and transforms it into a nerve stimulus, which in turn is transferred to the brain by nerve fibers.

Nearsightedness is a phenomenon in which the ciliary muscle of the ciliary body is abnormally strained and accordingly the suspensory ligament is relaxed causing the lens to become thicker whereby the incoming light is focused in front of the retina and the retina receives obscure images.

To rectify nearsightedness, glasses which comprise a pair of concave artificial lenses are employed so that the light rays reflected from objects are properly focused on the retina.

While farsightedness, hyperopia is a phenomenon in which the ciliary muscle is abnormally relaxed causing the lens to become thinner whereby the incoming light rays are focused in back of the retina and the retina again receives obscure images.

To rectify the farsightedness, glasses which comprise a pair of convex artificial lenses are employed so that the light rays reflected from objects properly focuses on the retina.

The following are the main reasons for nearsightedness;

A long period of close work which compels a person to constantly look at an object which is within 40cm from the eyes, fatigue of the eyes, a nutritionally unbalanced diet, and an internal or hereditary disease.

Nearsightedness of myopia takes several steps to develop: there is stationary myopia in the elementary stage, a refractive myopia in the secondary stage, an axial myopia in the third stage, and the detachment of the retina in the final stage. Stationary myopia is a phenomenon in which the lens stays abnormally thick due to long abnormal strain of ciliary muscle caused by continuous close work and the lens will become only slightly thinner even if the eyes try to observe distant objects. Refractive myopia is a more advanced phenomenon in which the reflection of the incoming light is no longer adjustable and also the structure of the retina has become abnormal. Axial myopia is a further advanced phenomenon in which the lens becomes extremely and abnormally thick and the shape of the eyeball becomes elliptical due to an elongation of the eyeball. When axial myopia is further developed, detachment of the retina occurs resulting in the loss of visual acuity.

Genuine myopia is a general term for refractive myopia and axial myopia.

In general, myopia appears in a complex form of stationary myopia and genuine myopia.

Stationary myopia and some cases of genuine myopia are subject to the application of the method of this invention.

Attendant to myopia are the problems such as the inconveniency of wearing glasses, lowered efficiency of study or work both of which result in causing a person to have a depressed personality.

Conventional treatments of myopia which have been developed and practiced are as following:

chemical treatment such as the use of eyedrop solutions, physical treatment such as the application of supersonic waves, surgical treatment such as the removal of the lens, and treatment of recovering visual acuity by suitable exercises.

However, attendant to each above treatment is a problem such as the dependancy on eye drop solutions, the prolonged use of which may be hazardous to the eye, the loss of the accommodation function due to the surgical operation, and the necessity of using expensive instruments as in the case of treatment with sonic waves.

Therefore, a method for treatment of myopia which has no attendant difficulty has been desired by those who are skilled in the art.

Conventionally, there have been two theories regarding the relationship between the ciliary body (ciliary muscle) and myopia. One theory proclaims that the ciliary body is an involuntary muscle and therefore is not subject to the autonomic nervous system which is controlled by the parasypathetic nerves so that the myopia is completely hereditary and is not curable. Another theory proclaims that the ciliary muscle is subject to two nervous systems, that is, the contraction of the ciliary muscle is caused by the parasypathetic nerves and the relaxation of the ciliary muscle is caused by the sympathetic nerves, so that the myopia is curable.

According to a recent theory, it has been clarified by experiments that although the ciliary muscle is an involuntary muscle, it is subject to the integration of the neocortex cerebri system as well as the limbic system.

The present invention provides a new ocular device which may be used most effectively in the methodology relating to the therapeutic treatment of myopia.

Accordingly, it is an object of the invention to provide a visual acuity chart so that visual acuity can be reliably checked and measured without inaccurate results occuring due to the patient's memorizing in advance the sizes and locations of breaks of Landolt's rings, since the sizes and locations of the breaks of the rings can be easily changed at any time.

It is also an object of the invention to provide a visual acuity chart which can be employed for the therapeutic treatment of nearsightedness.

DETAILED DESCRIPTION OF THE INVENTION

The device which is employed in the method of this invention is hereinafter described.

The device used in the method of this invention is a kind of visual acuity chart, the structure of which is such that the size of the Landolt's rings as well as the location of the break of each ring can be freely and easily selected for the purpose of treating patients with different visual acuities.

Furthermore, the shape of the chart should preferrably be a symmetrical shape, every side of which is equidistant from a fixed center, such as a circle or a regular polygon, such as a hexagon and octagon, to enable a patient to see the rings of various sizes and with the breaks in different locations under the same conditions while sitting on a chair.

Figure 2A:
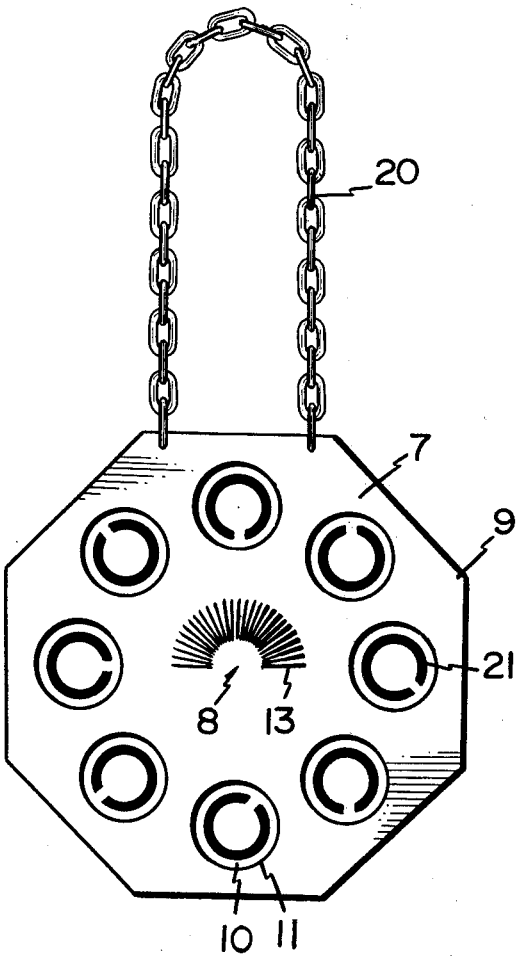
FIG. 2A is a front elevation of a visual acuity chart according to a preferred embodiment of the present invention.
Figure 2B:
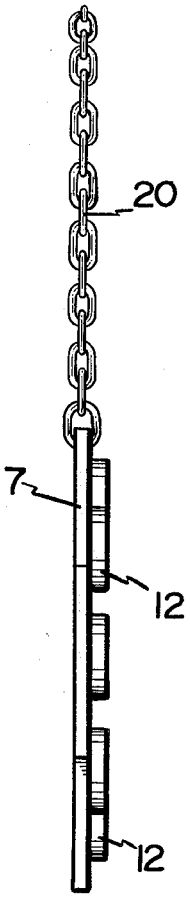
FIG. 2B is a side view of the same.
Figure 2C:
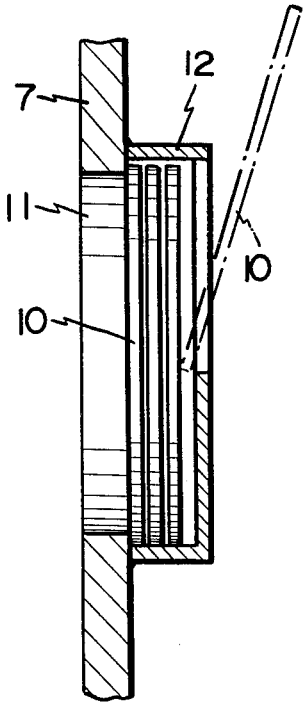
FIG. 2C is an enlarged view of FIG. 2B.

FIGS. 2A,2B and 2C show a preferred embodiment of the visual acuity chart. Shape of the chart 7 is a regular octagon and the distance between the center 8 and each corner 9 is 23 to 25cm. A plurality of openings 11 (this chart has eight openings) are positioned on the chart 7 equidistant from the center 8 and regulary spaced.

Each opening 11 comprises a circular cut-out portion having a diameter of 4.5 to 5.Ocm and a slot or container 12 preferrably made of flexible materials containing several small circular plates 10 attached in back of the cut-out portion as shown in FIG. 2C. A small circular plate 10 which has both sides printed with rings 21 of different sizes in the range of 0.1 to 2 of Landolt's ring standard (Index) is rotatably and replaceably displayed in the opening 11. Each slot 12 may have additional small circular plates 10 on which the rings of different sizes from those of the displayed ring are printed. They are prepared for quick exchanging of plates.

Additionally, as shown in FIG. 2A an angular chart 13 is printed on the chart 7 at the central portion thereof while a chain 20 which has both ends secured to the upper periphery of the chart 7 is employed for suspending the chart.

Figure 3A:
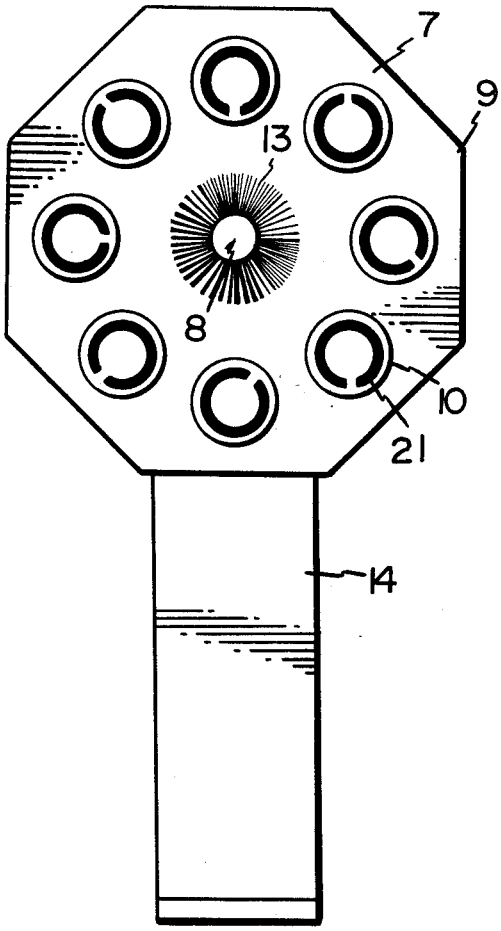
FIG. 3A is a front elevation of a visual acuity chart attached to an L-shaped stand according to an alternate embodiment of the present invention.
Figure 3B:
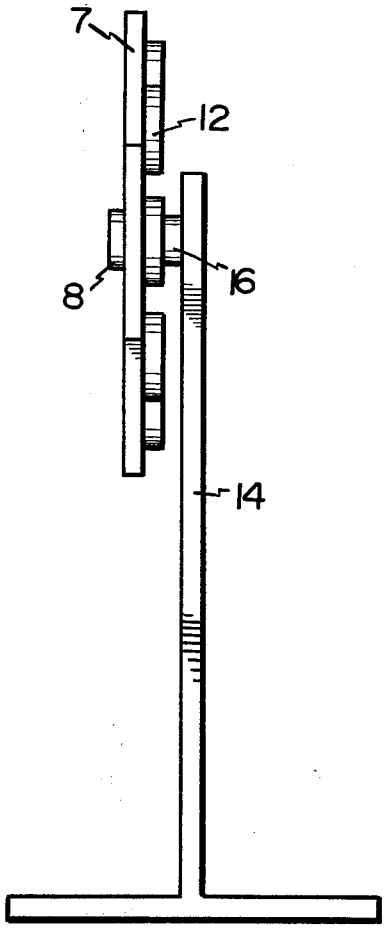
FIG. 3B is a side view of the same.
Figure 3C:
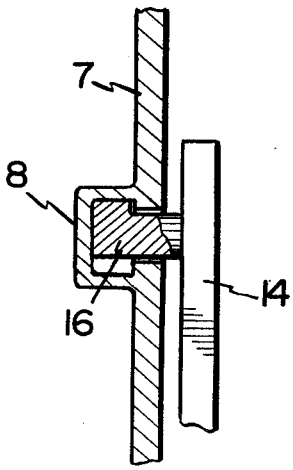
FIG. 3C is an enlarged sectional view of the shaft portion of the parent plate of FIG. 3B.
Figure 4A:
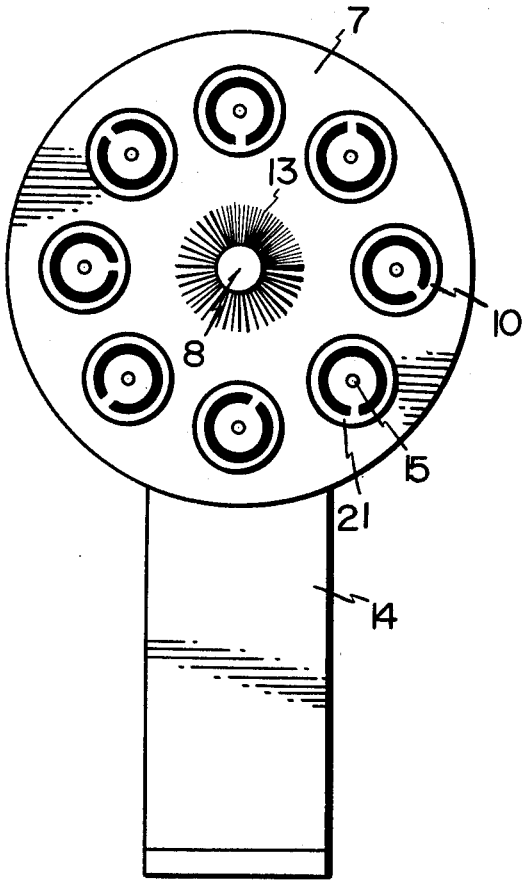
FIG. 4A is a front elevation of a visual acuity chart attached to an L-shaped stand according to a further alternate embodiment of the present invention.
Figure 4B:
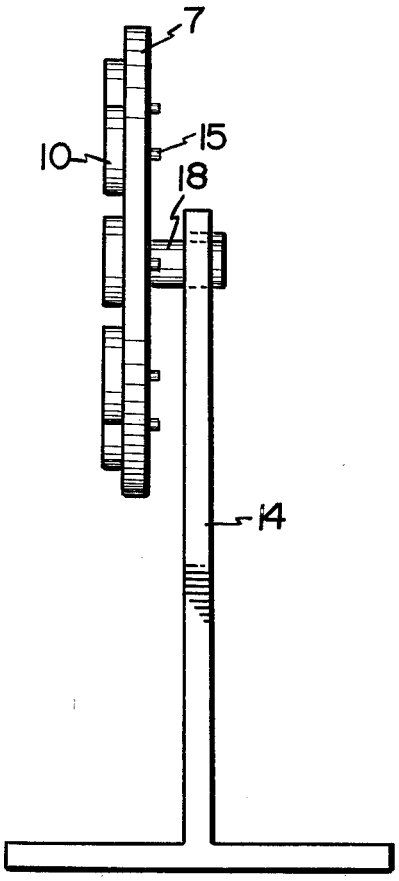
FIG. 4B is a side view of the same.
Figure 4C:
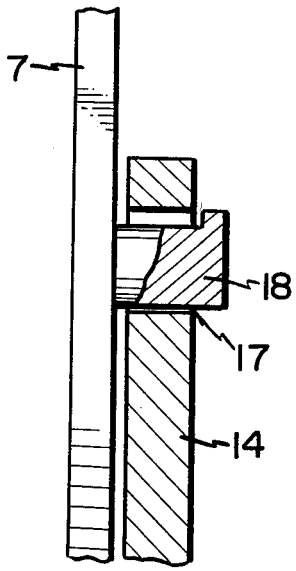
FIG. 4C is an enlarged sectional view of the shaft portion of the parent plate of FIG. 4B.
Figure 4D:
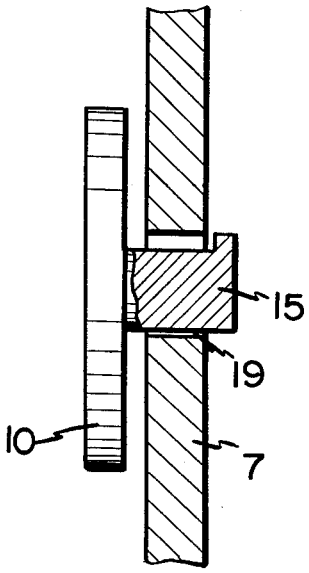
FIG. 4D is the enlarged sectional side view of the shaft portion of one of the small plates of FIG. 4B.

As shown in FIGS. 3A,3B and 3C, the visual acuity chart 7 comprises an octagonal plate 7 which is rotatably mounted on a protruded shaft 16 which is attached to an L-shaped stand 14. FIG. 3C shows an enlarged view of the shaft portion of the plate.

Figure 5A:
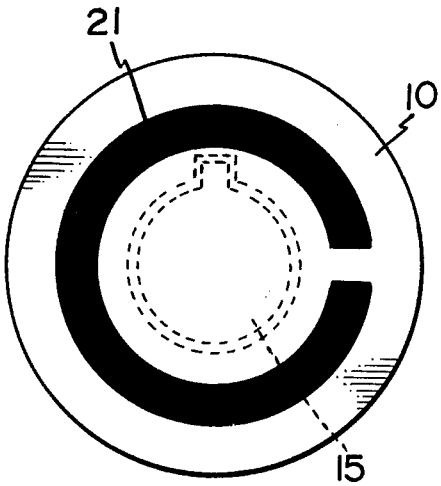
FIG. 5A is an enlarged front elevation of one of the small plates of another embodiment of the present invention.
Figure 5B:
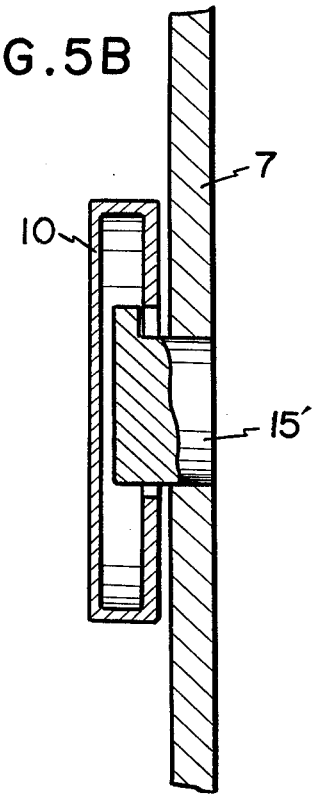
FIG. 5B is a sectional side view of the same.

FIGS. 4A,4B,4C and 4D show a visual acuity chart which comprises a circular plate 7 which is rotatably mounted by means of shaft portion 18 disposed in a hole 17 which is provided through the upper part of a pillar 14. A plural number of small circular plates 10 which are also rotatably mounted through a hole 19 which are provided on the parent circular plate 7 at the positions as those described above with their shaft portions 15. As shown in FIG. 5A, small circular plates 10 can also be rotatably secured on the shaft 15' which are attached to the said parent circular plate 7 as shown in FIG. 5B.

The letters or drawings which are printed on the visual acuity chart are not limited to the ones which are described heretofore, but other letters or drawings or colors also can be used.

The material of the visul acuity chart is preferably made of white, non-reflective substance such as plastic, Celluloid, or cardboard.

It is an object of the invention to provide a visual acuity chart so that visual acuity can be reliably checked and measured without inaccurate results occuring due to the patient's memorizing in advance the sizes and locations of breaks of Landolt's rings, since the sizes and locations of the breaks of the rings can be easily changed at any time.

It is also an object of the invention to provide a visual acuity chart which can be employed for the therapeutic treatment of nearsightedness, and is hereinafter described in a greater detail.

The method of this invention is based on the following technical idea that in order to see a distant object, the light rays reflected from the object must be properly focused on the retina by extending the focal length of the light passing into the eye. In other words, seeing a distant object causes the action on the eyes of relaxing the tension of the ciliary muscle that is caused by seeing a nearby object, thereby the suspensory ligament is strained making the lens thinner.

In the case of seeing a nearby object, the opposite action takes place.

The repetition of this sequence of actions of the visual function not only causes the eye to recover abnormal strain caused by fatigue of the ciliary body, but also to recover the visual acuity when observing a distant object.

In short, the method is based on the experience as well as knowledge that the visual organs which are abnormally strained or relaxed can be expected to recover to a normal condition by means of the repetition of visual actions of opposing functions.

Stationary myopia and some cases of genuine myopia, both of which are phenomena in which the ciliary muscle is kept abnormally strained due to continuous close work which thereby causes temporary difficulty in seeing distant objects are expected to recover by the intentional repetition of focusing on a distant object and then a nearby object which brings about the relaxation of an abnormally strained ciliary muscle so that the lens becomes thinner which results in the normal condition of the eye and the eye in turn becomes capable of seeing a distant object clearly.

The object of the invention relates to a method for the therapeutic treatment of myopia in which the normal condition of the ciliary muscle is recovered by the relaxation of the abnormal strain of the ciliary muscle by means of an alternate repetition of focusing the eye on a distant object and a nearby object.

In other words, this invention relates to a therapeutic treatment of myopia which returns the ciliary muscle (body) to the normal condition by the alternate repetition of focusing on Landolt's rings and focusing on a nearby object while wearing convex glasses of a suitable degree. Convex glasses are employed for intentionally weaking the visual acuity of a patient than that of the patient when wearing no glasses and for stimulating the ciliary muscle to act so that the lens becomes thinner.

The physical method for the therapeutic treatment of nearsightedness which is based on the above principle is described hereinafter.

Usually, when checking the visual acuity using Landolt's eye table, a patient is asked to stand 5m from the table, in this invention, however, the distance is required to be between 0.5 to 2.5m because of the use of convex lenses (glasses). Their use is described hereinafter in greater detail.

Prior to the treatment, a patient is asked to wear convex glasses, the diopter of which corresponds to the visual acuity of the patients' naked eyes. Small circular plates with rings of a size which also correspond to the visual acuity of the patients' naked eyes are inserted into the openings of the chart, For example, a small ring for a patient with a weak myopia or a large ring for a patient with strong myopia may be inserted.

In this case, a plural number of small circular plates on which are printed rings of the same size are inserted into an equal number of openings and the locations of the breaks of the rings differ widely.

The diopter of the convex lens to be worn, or the size of the Landolt's ring that is chosen corresponds to the visual acuity of a patients' naked eye as described in the following table.

| Visual acuity of the naked eye of the patient | | Diopter of the convex lenses worn by the patient | Size of the Landolt's ring (Index of international chart of visual acuity) | Number of a small plate used in this specification |
|---|---|---|---|---|
| more than | 0.5 | + 2.0 | 1.5 | No.6 |
| 0.3 | 0.5 | + 1.75 | 1.2 | No.5 |
| 0.1 | 0.3 | + 1.50 | 0.8 | No.4 |
| 0.08 | 0.1 | + 1.25 | 0.6 | No.3 |
| 0.05 | 0.08 | + 1.00 | 0.4 | No.2 |
| less than | 0.05 | + 0.75 | 0.2 | No.1 |

This chart should be mounted in a suitable place in a room wherein the room is of equal brightness at any one place, and preferably is without a light source or window which may allow light to enter the room in the visual field of a patient.

The center of the visual acuity chart is preferably at the same level as the patient's eyes while the patient is seated in a chair. When treating a patient at night, the intensity of illumination of the room is preferably more than 200 lux.

For convenience, the plural number of openings are affixed with numbers in such a way that the top opening is affixed with No. 1, and the other openings are affixed with sequential numbers in a clockwise direction starting from the top opening No. 1.

Figure 1:
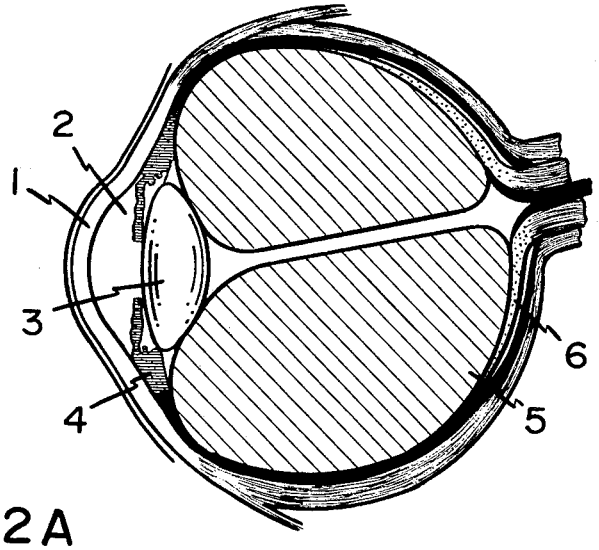
FIG. 1 is a horizontal section of an eyeball.

A patient who wears glasses with convex lenses first stands about 50cm in front of the chart in which a plural number of small plates with Landolt's rings have been placed. He walks toward or away from the chart until he can manage to clearly see the location of the breaks of rings and then sits down on a chair. After that he starts staring at the Landolt's ring No. 1 following the instruction delivered by a timer or a tape recorder. One action consists of focusing and staring at a Landolt's ring for about 25 seconds and focusing and staring at a nearby object such as the palm of a hand 30cm away from the eyes for about 5 seconds. This focusing and staring action is repeated on each opening of the chart clockwise and in sequence resulting in eight repetitions of the focusing and staring action when the chart of FIG. 1 is employed.

The setting of 25 seconds as the time period for focusing and staring at a Landolt's ring was determined based on the results of experiments with an ordinary patient who could continue to focus and stare at the above ring for 25 seconds without being aware of fatigue of the eyes. This setting of the time period can be changed to suit the patient to be treated.

When the patient is able to clearly see the location of the break of a ring within 15 seconds, he walks 10cm away from the chart and continues to focus and stare at the ring for the remaining 10 seconds.

If the patient can clearly see the location of the break of the ring between 15 and 25 seconds, he continues staring at the ring without walking away from the chart.

If the patient cannot clearly see the location of the break even after 25 seconds, he walks 5 cm towards the chart while focusing and staring at a nearby point, and then continues the above focusing and staring action.

If a patient moves back to a position 2.5m away from the chart while repeating the above focusing and staring actions, the circular plates are exchanged with a new set of circular plates with smaller rings than the former ones and the location of the breaks of the new rings is also changed in a random manner. Once again the above mentioned focusing and staring actions are repeated.

When the visual acuity chart has eight openings as shown in FIG. 1, at least 4 minutes are required to complete one round which consists of eight repetitive actions. Preferably about nine rounds of the focusing and staring actions are performed in 1 day. Furthermore, the nine rounds should be divided into three practice periods wherein each practice period consists of three rounds or twelve minutes of focusing and staring rather than completing the entire series at on time.

Since the above method for the therapeutic treatment of myopia may vary depending on the individual patient, the time of the treatment should be increased or decreased and the intervals of the treatment should be varied also to correspond to the fatigue of the patients' eyes. Prefarably, the treatment should be performed while dividing the practice periods into a suitable number so that the patient will not become fatigued.

It is desirable that the visual acuity of the patient's naked eyes be checked sometime during the treatment period using an internationally-authorized visual acuity chart in order to check the recovery of the patient.

Figure 6A:
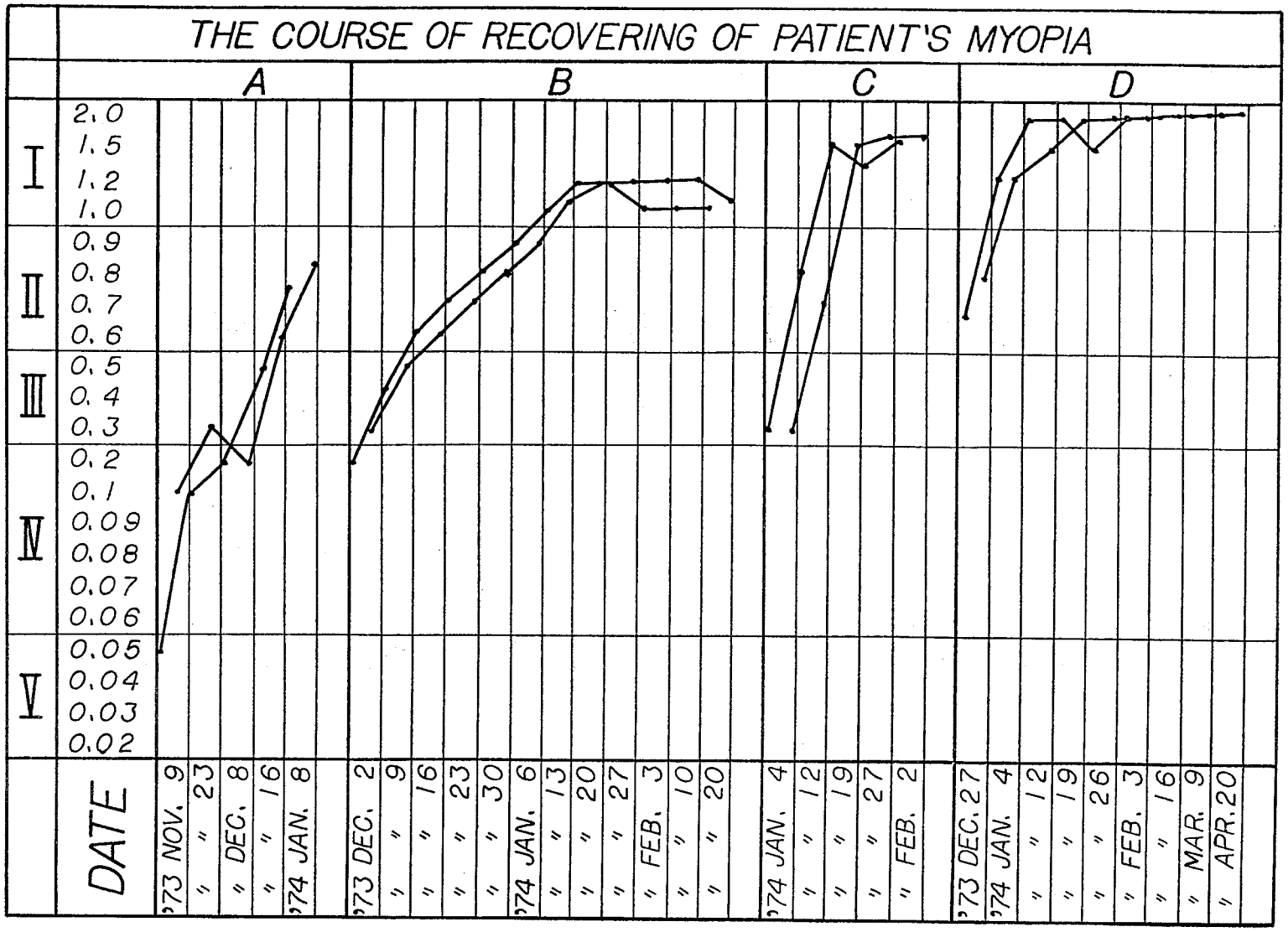
FIGS. 6A to 6C are the tables which show the course of recovery of patients' myopia according to the process of the present invention in which I indicates normal visual acuity; II indicates primary myopia; III shows slight myopia; IV shows intermediate myopia; and V shows severe myopia.
Figure 6B:
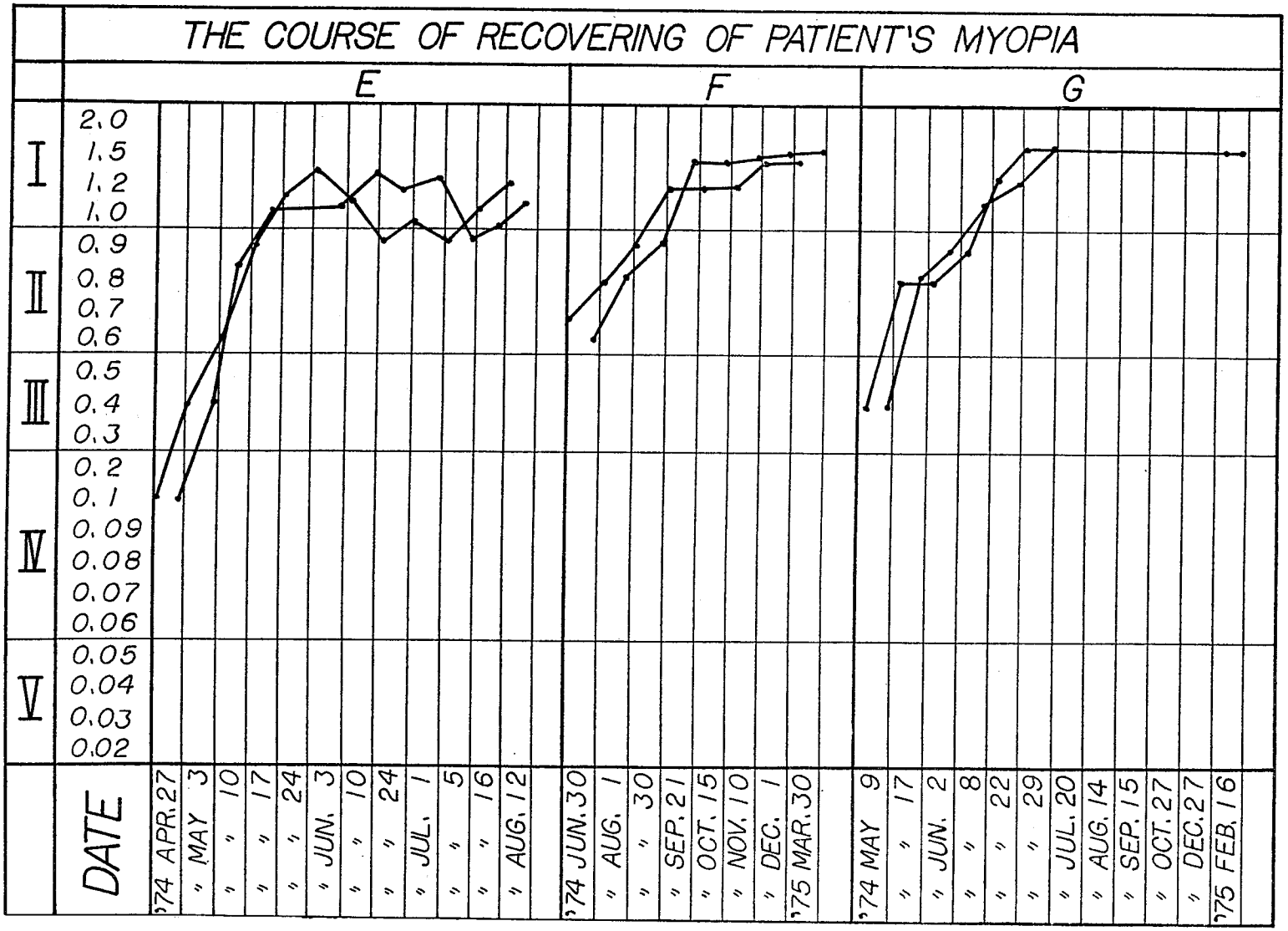
Figure 6C:
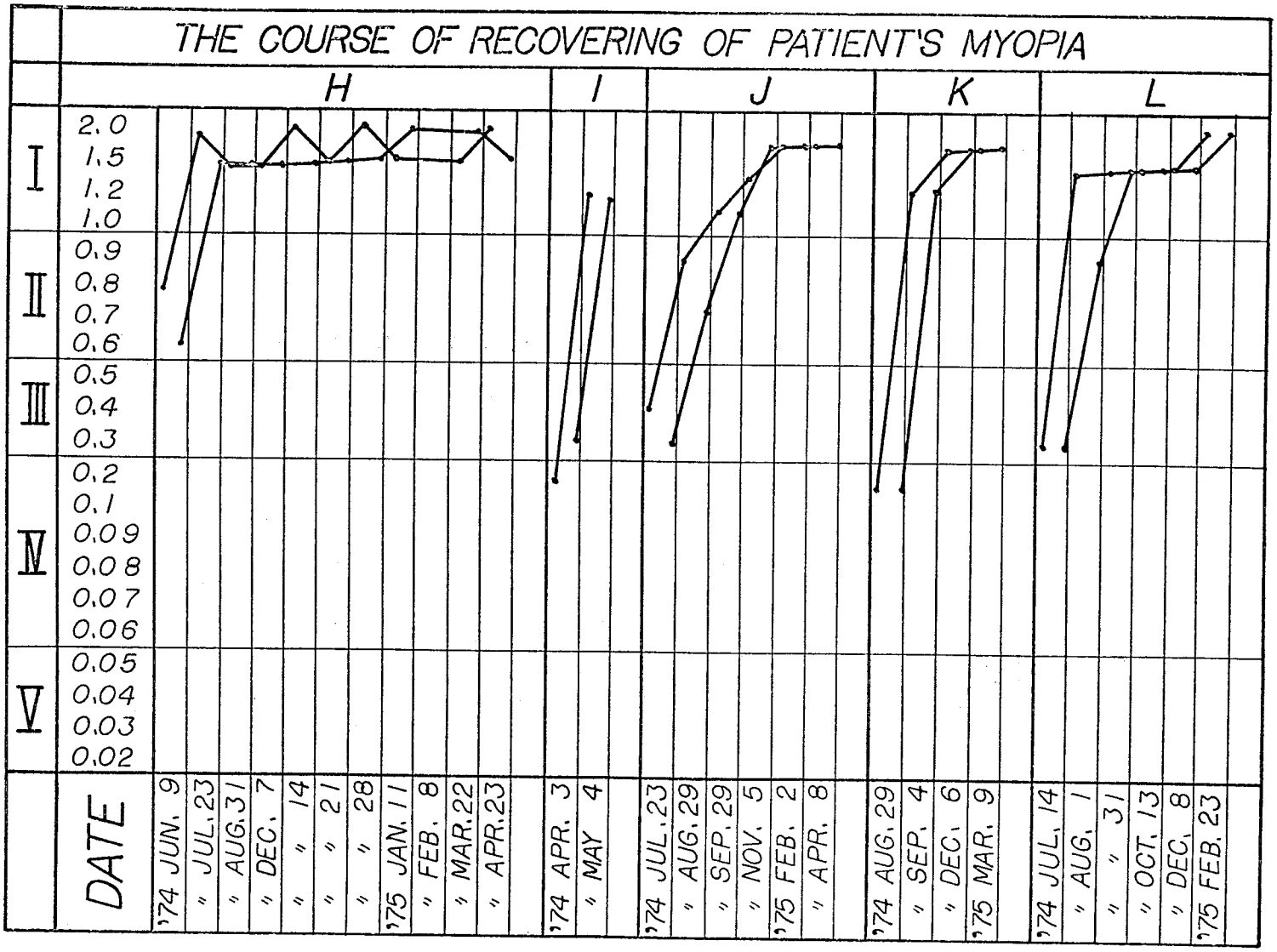

The following tables show the result of the treatment according to the process of the present invention and the graphs in FIGS. 6A to 6C show the courses of recovering of patients' myopia.

Table 1

The result of the treatment according to the process of this invention from November 1973 to February 1974.

| patient | age | sex | visual acuity before treatment right | visual acuity before treatment left | visual acuity after treatment right | visual acuity after treatment left | period to the recovery (days) |
|---|---|---|---|---|---|---|---|
| A | 18 | male | 0.1 | 0.05 | 0.9 | 0.8 | 59 |
| B | 12 | male | 0.3 | 0.2 | 1.2 | 1.0 | 59 |
| C | 9 | female | 0.3 | 0.3 | 1.5 | 1.5 | 28 |
| D | 8 | female | 0.8 | 0.7 | 2.0 | 2.0 | 37 |

Table 2

The result of the treatment according to the process of this invention from April 1974 to November 1974.

| patient | age | sex | visual acuity before treatment right | visual acuity before treatment left | visual acuity after treatment right | visual acuity after treatment left | period to the recovery (days) |
|---|---|---|---|---|---|---|---|
| E | 10 | female | 0.1 | 0.1 | 1.2 | 1.0 | 37 |
| F | 9 | female | 0.6 | 0.7 | 1.5 | 1.5 | 83 |
| G | 8 | female | 0.4 | 0.4 | 1.5 | 1.5 | 51 |
| H | 7 | female | 0.7 | 0.6 | 1.5 | 2.0 | 44 |

Table 3

The result of the treatment according to the process of this invention from July 1974 to February 1975.

| patient | age | sex | visual acuity before treatment right | visual acuity before treatment left | visual acuity after treatment right | visual acuity after treatment left | period to the recovery (days) |
|---|---|---|---|---|---|---|---|
| I | 15 | female | 0.3 | 0.2 | 1.2 | 1.2 | 30 |
| J | 12 | female | 0.3 | 0.4 | 1.5 | 1.5 | 70 |
| K | 11 | female | 0.2 | 0.2 | 1.5 | 1.5 | 37 |
| L | 10 | female | 0.3 | 0.3 | 2.0 | 2.0 | 48 |

What I claim is:

1. A visual acuity chart used in the therapeutic treatment of nearsightedness comprising a parent plate, a plurality of small circular plate elements having different sizes of Landolt's rings printed thereon, and mounting means for attaching said circular plate elements to said parent plate in a circular pattern at regular intervals from the center of said parent plate, said mounting means providing for rotatably and changeably attaching said circular plate elements to said parent plate whereby the size and location of the break in the Landolt's rings can be selectively changeable.

2. A visual acuity chart according to claim 1 wherein said mounting means comprises a plurality of openings in said parent plate disposed in a circular pattern at regular intervals from the center of said parent plate, said circular plate elements being viewable through said openings in said parent plate.

3. A visual acuity chart according to claim 2 further comprising container means on the back of said parent plate disposed about each of said openings in said parent plate, a plurality of said small circular plate elements being insertable into each of said container means from the back of said parent plate, one of said small circular plate elements in each of said container means being viewable from the front of said parent plate through said openings, said small circular plate elements being insertable in and removable from said container means and being manually rotatable therein to thereby provide for selectively changing the size and the location of the break of the Landolt's rings.

4. A visual acuity chart according to claim 1 wherein said mounting means comprises a plurality of passages in said parent plate, said small circular plate elements having shafts thereon rotatably mounted in said passages.

5. A visual acuity chart according to claim 1 wherein said mounting means comprises a plurality of shafts secured to said parent plate, said small circular plate elements being rotatably mounted on said shafts.

6. A visual acuity chart according to claim 1 including a stand, and means for rotatably mounting said parent plate on said stand.

7. A visual acuity chart according to claim 1 wherein said parent plate has a circular configuration.

8. A visual acuity chart according to claim 1 wherein said parent plate has a polygonal configuration.

9. A visual acuity chart according to claim 8 wherein said parent plate has a hexagonal configuration.

10. A visual acuity chart according to claim 8 wherein said parent plate has an octagonal configuration.

11. A visual acuity chart according to claim 1 wherein said parent plate is suspended by a chain or string.

* * * * *